US008403324B2

(12) United States Patent
Shirakata

(10) Patent No.: US 8,403,324 B2
(45) Date of Patent: Mar. 26, 2013

(54) SHEET SKEW FEEDING CORRECTING APPARATUS AND IMAGE FORMING APPARATUS

(75) Inventor: Jiro Shirakata, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/039,551

(22) Filed: Mar. 3, 2011

(65) Prior Publication Data

US 2011/0227279 A1 Sep. 22, 2011

(30) Foreign Application Priority Data

Mar. 17, 2010 (JP) ..... 2010-060152

(51) Int. Cl.
*B65H 9/04* (2006.01)

(52) U.S. Cl. ..... 271/245; 271/246; 271/226

(58) Field of Classification Search ..... 271/243–245, 271/226, 246
See application file for complete search history.

(56) References Cited

U.S. PATENT DOCUMENTS

| | | | | |
|---|---|---|---|---|
| 3,949,979 | A * | 4/1976 | Taylor et al. | 271/10.01 |
| 4,135,804 | A * | 1/1979 | Schoppe et al. | 399/396 |
| 6,011,948 | A * | 1/2000 | Amano et al. | 399/395 |
| 6,135,447 | A * | 10/2000 | Lin | 271/229 |
| 7,537,210 | B2 * | 5/2009 | Kawaguchi | 271/226 |
| 2002/0020960 | A1 * | 2/2002 | Waragai et al. | 271/226 |

FOREIGN PATENT DOCUMENTS

| | | |
|---|---|---|
| JP | 2000-233849 | 8/2000 |
| JP | 3981485 | 9/2007 |

* cited by examiner

*Primary Examiner* — Michael McCullough
*Assistant Examiner* — Howard Sanders
(74) *Attorney, Agent, or Firm* — Fitzpatrick, Cella, Harper & Scinto

(57) ABSTRACT

A sheet skew feeding correcting apparatus includes a shutter member which abuts against a leading end of the sheet conveyed by the conveying apparatus, the shutter member is movable between a first attitude where the shutter member abuts against the leading end of the sheet and a second attitude where the shutter member permits the sheet to pass therethrough, and a loop abutting portion against which a loop portion of the sheet formed while the sheet is conveyed by the first sheet conveying apparatus, wherein the loop portion of the sheet whose leading end is abut against the shutter member moves the shutter member from the first attitude to the second attitude by a force pressing the loop abutting portion.

10 Claims, 13 Drawing Sheets

*FIG. 8A*
DISPOSITION OF SHUTTER MEMBER

| | | ORIGIN OF TURNING CENTER | | POLAR COORDINATES (RADIUS AND DIRECTION) | |
|---|---|---|---|---|---|
| No | | X | Z | R | θ (deg) |
| 1 | ROTATION CENTER | 0.00 | 0.00 | | |
| 2 | SHEET LOCKING PORTION | R2Cosθ2 = 35.41 | R2Sinθ2 = 17.04 | R2 = 39.3 | θ2 = 25.7 |
| 3 | LOOP ABUTTING PORTION | R3Cosθ3 = 67.39 | R3Sinθ3 = 0.94 | R3 = 67.4 | θ3 = 0.8 |

*FIG. 8B*
SHAPE OF SHUTTER MEMBER

| No | | | θ (deg) |
|---|---|---|---|
| 4 | SHEET LOCKING PORTION | | θ4 = 0.0 |
| 5 | LOOP ABUTTING PORTION | | θ5 = 90.0 |

*FIG. 8C*
DIRECTIONAL VECTOR OF APPLICATION FORCE TO SHUTTER MEMBER

| No | | | θ (deg) |
|---|---|---|---|
| 6 | SHEET LOCKING PORTION | | $\theta 6 = 153.3$ |
| 7 | LOOP ABUTTING PORTION (DOWNSTREAM) | | $\theta 7 = -26.7$ |
| 8 | LOOP ABUTTING PORTION (UPSTREAM) | | $\theta 8 = -156.5$ |

*FIG. 8D*
FORCE N (VERTICAL DRAG) ON SHUTTER MEMBER WHICH IS PUSHED BY SHEET CONVEYING FORCE F

| No | | VERTICAL DRAG | θ (deg) |
|---|---|---|---|
| 9 | SHEET LOCKING PORTION | $N9 = F \cdot \mathrm{Cos}(\theta 4 + \pi - \theta 6) = 0.89F$ | $\theta 9 = 180.0$ |
| 10 | LOOP ABUTTING PORTION (DOWNSTREAM) | $N10 = F \cdot \mathrm{Cos}(\theta 5 + \pi - \theta 7) = 0.45F$ | $\theta 10 = 270.0$ |
| 11 | LOOP ABUTTING PORTION (UPSTREAM) | $N11 = F \cdot \mathrm{Cos}(\theta 5 + \pi - \theta 8) = 0.40F$ | $\theta 11 = 270.0$ |

*FIG. 8E*

FRICTION FORCE BETWEEN TIP END OF SHEET AND LOOP PORTION (FRICTION COEFFICIENT BETWEEN TIP END OF SHEET AND SHEET LOCKING PORTION $\mu$ = 0.40)

| No | | FRICTION FORCE BETWEEN TIP END OF SHEET AND SHEET LOCKING PORTION | $\theta$ (deg) |
|---|---|---|---|
| 12 | SHEET LOCKING PORTION | $F12 = \mu \cdot N9 = 0.36F$ | $\theta 12 = 90.0$ |

*FIG. 8F*

MOMENT M OF EACH FORCE APPLIED TO SHUTTER MEMBER

| No | | MOMENT |
|---|---|---|
| 13 | SHEET LOCKING PORTION (DRAG) | $M13 = N9 \cdot R2 \cdot \mathrm{Cos}(\theta 9-(\theta 2+\pi/2)) = 15.17F$ |
| 14 | SHEET LOCKING PORTION (FRICTION FORCE) | $M14 = \lvert F12 \cdot R2 \cdot \mathrm{Cos}(\theta 12-(\theta 2+\pi/2)) \rvert = 12.75F$ |
| 15 | LOOP ABUTTING PORTION (DOWNSTREAM) | $M15 = N10 \cdot R3 \cdot \mathrm{Cos}(\theta 10-(\theta 3+\pi/2)) = -30.33F$ |
| 16 | LOOP ABUTTING PORTION (UPSTREAM) | $M16 = N11 \cdot R3 \cdot \mathrm{Cos}(\theta 11-(\theta 3+\pi/2)) = -26.95F$ |

SHEET SKEW FEEDING CORRECTING APPARATUS AND IMAGE FORMING APPARATUS

BACKGROUND OF THE INVENTION

1. Field of the Invention

The present invention relates to a sheet skew feeding correcting apparatus capable of correcting skew feeding of a conveyed sheet, and an image forming apparatus equipped with the sheet skew feeding correcting apparatus.

2. Description of the Related Art

Conventionally, in an image forming apparatus and its peripheral devices, skew feeding of a sheet is corrected so that an image and the sheet are aligned to correct positions for an output image which is a deliverable, and image quality is maintained. In this regard, there are proposed several sheet skew feeding correcting apparatuses which correct skew feeding of sheets only by a conveying force of a sheet without using an actuator.

For example, Japanese Patent Laid-open No. 2000-233849 proposes a configuration where a force is applied to a shutter member, the shutter member is turnably supported on the roller shaft of one of a pair of rollers, and the leading end of a conveyed sheet strikes the shutter member. The shutter member is turned and pushed opened by an abutting force from the leading end of the conveyed sheet, and the skew feeding of the sheet is corrected at that time. The sheet whose skew feeding was corrected is nipped and conveyed between the pair of downstream rollers.

To avoid a difference in timing of a shutter opening operation caused by a firmness difference between sheets, there is also proposed the configuration having a shutter locking member which restricts the shutter member, and the locking member is unlocked by a loop of the sheet. According to this configuration, the shutter is operated only when the loop reaches a predetermined value.

In the shutter configuration, however, it is necessary to turn the shutter against a force applied to the shutter using an abutting force of the leading end of the sheet. The abutting force of the leading end of the sheet is prone to be influenced by the state of a sheet (e.g., firmness of a sheet). Therefore, there is the unwanted possibility that if firmness of a sheet is weak, the shutter cannot be turned, and if firmness of a sheet is strong, the shutter may be turned with skew feeding insufficiently corrected.

In the configuration where the locking member of the shutter is unlocked by a loop of a sheet, there is the unwanted possibility of the loop buckling from a friction force between the locking member and the shutter member, resulting in operation failure of the shutter.

SUMMARY OF THE INVENTION

The present invention provides a sheet skew feeding correcting apparatus capable of properly correcting skew feeding of a sheet irrespective of the firmness of the sheet without using a complicated link mechanism, and an image forming apparatus equipped with the sheet skew feeding correcting apparatus.

According to an exemplary configuration of the present invention, there is provided a sheet skew feeding correcting apparatus which comprises: a sheet conveying apparatus which conveys a sheet; a pair of sheet conveying rotating members which is disposed downstream of the sheet conveying apparatus in a sheet conveying direction; a shutter member which abuts against a leading end of the sheet conveyed by the conveying apparatus at upstream of a nip portion of the pair of sheet conveying rotating members, the shutter member is movable between a first attitude where the shutter member abuts against the leading end of the sheet and a second attitude where the shutter member permits the sheet to pass therethrough; and a loop abutting portion against which a loop portion of the conveyed sheet whose leading end is abut against the shutter member abuts, wherein the loop portion of the sheet moves the shutter member from the first attitude to the second attitude by a force pressing the loop abutting portion.

According to the invention, it is possible to reliably open the shutter.

Further features of the present invention will become apparent from the following description of exemplary embodiments with reference to the attached drawings.

BRIEF DESCRIPTION OF THE DRAWINGS

FIGS. 8A to 8F are diagrams for explaining the motion force to the shutter of the embodiment of the invention;

DESCRIPTION OF THE EMBODIMENTS

Next, an embodiment for carrying out the present invention will be described with reference to the drawings.

<General Configuration of Image Forming Apparatus>

Figure 11:
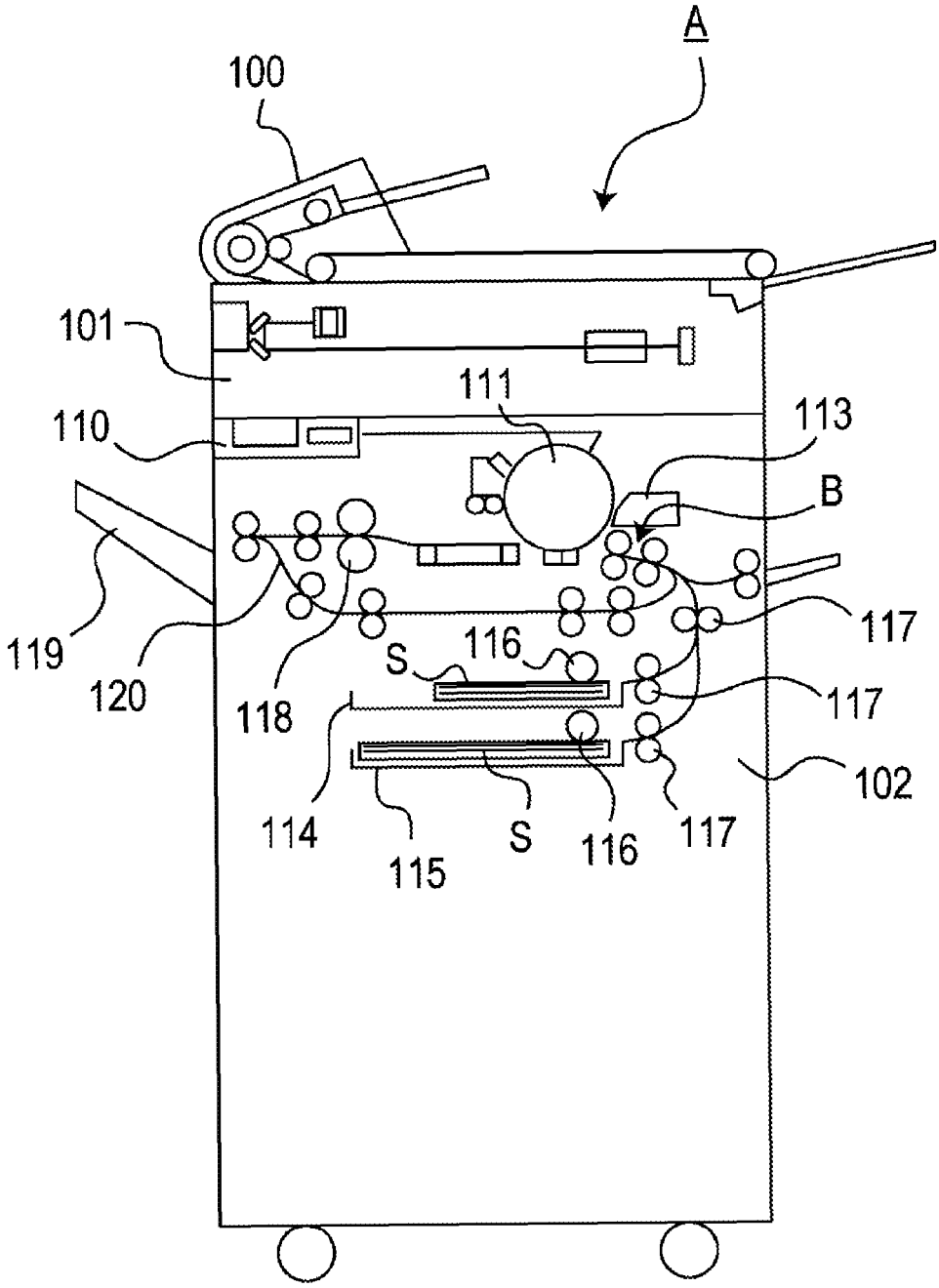
FIG. 11 is a diagram for explaining an image forming apparatus of the embodiment of the invention.

First, the general configuration of an image forming apparatus having a sheet skew feeding correcting apparatus according to the present invention will be described using FIG. 11.

The image forming apparatus A of the embodiment is a copying machine including a document feeding section 100 which separates and feeds a document sheet by sheet, an image reader section 101 which reads the fed document, and a printing section 102 which records image information on the sheet. The printing section 102 is provided with a sheet skew feeding correcting apparatus B which corrects skew feeding of a sheet fed to an image forming section.

The configuration of the printing section 102 provided with the sheet skew feeding correcting apparatus B will be described. The printing section 102 of this embodiment forms an image on a sheet using an electrophotographic system. Image information which has been read by the image reader section 101 or image information which has been sent from another device is sent to an exposure controlling section 110. A laser beam corresponding to an image signal is output from the exposure controlling section 110 to form an electrostatic latent image on a photosensitive drum 111, and the image is developed by a development device 113 to be visible as a toner image.

In synchronization with formation of the toner image, sheets selected from a cassette 114 or 115 are separated and fed one sheet by one sheet by feeding rollers 116 and a pair of conveying rollers 117, and the sheets are conveyed to the sheet skew correcting apparatus B. The sheet whose skew feeding has been corrected as the sheet passed through the sheet skew feeding correcting apparatus B is conveyed to the image forming section, and a toner image on the photosensitive drum 111 is transferred onto the sheet. The sheet which has the toner image transferred thereon is then sent to a fixing section 118. The sheet is heated and pressed in the fixing section 118, so that the toner image is permanently fixed. Then, the sheet is discharged onto a discharge tray 119 in the case of one-side recording, or is sent to a duplex conveying path 120 in the case of duplex recording.

The sheet skew feeding correcting apparatus B is provided in the sheet conveying path of the printing section 102, but another sheet skew feeding correcting apparatus B may be provided in a document conveying path of the document feeding section 100 to correct skew feeding of a conveyed document.

<Sheet Skew Feeding Correcting Apparatus>

Next, the configuration of the sheet skew feeding correcting apparatus B of the embodiment will be described.

Figure 1:
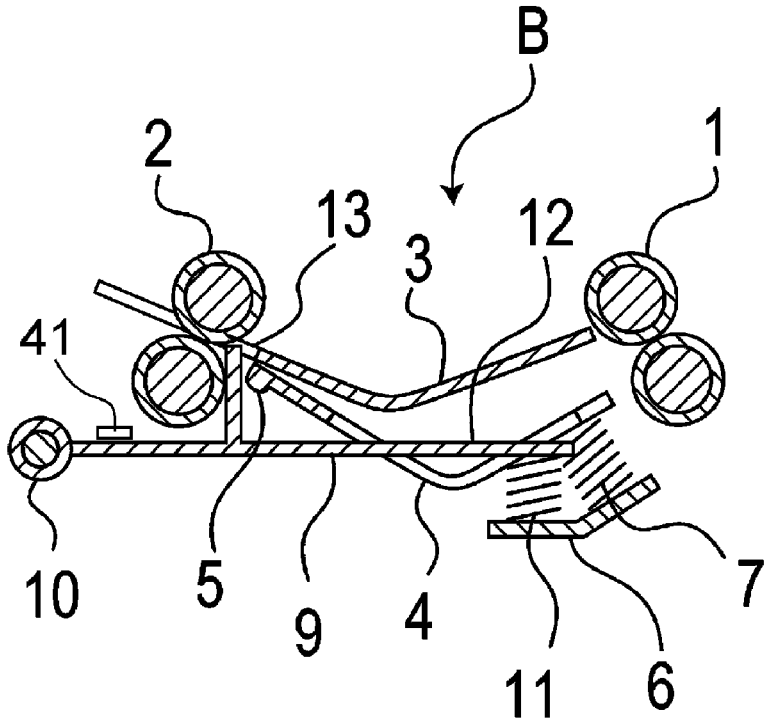
FIG. 1 is a schematic sectional view of a sheet skew feeding correcting apparatus according to an embodiment of the present invention.
Figure 2:
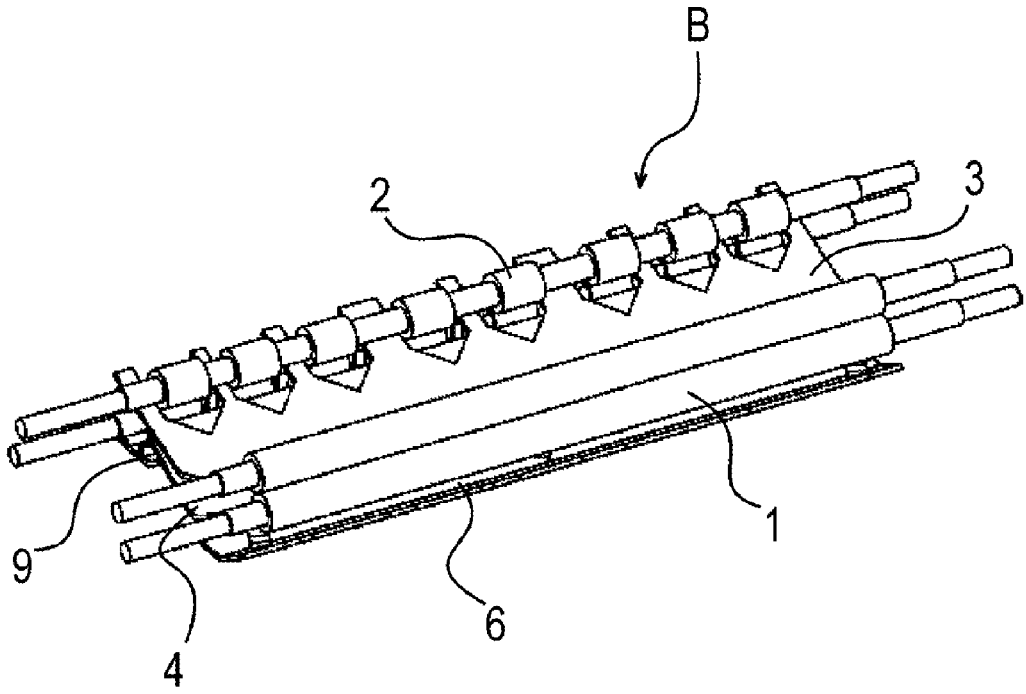
FIG. 2 is a schematic perspective view of the sheet skew feeding correcting apparatus of the embodiment of the invention.
Figure 3:
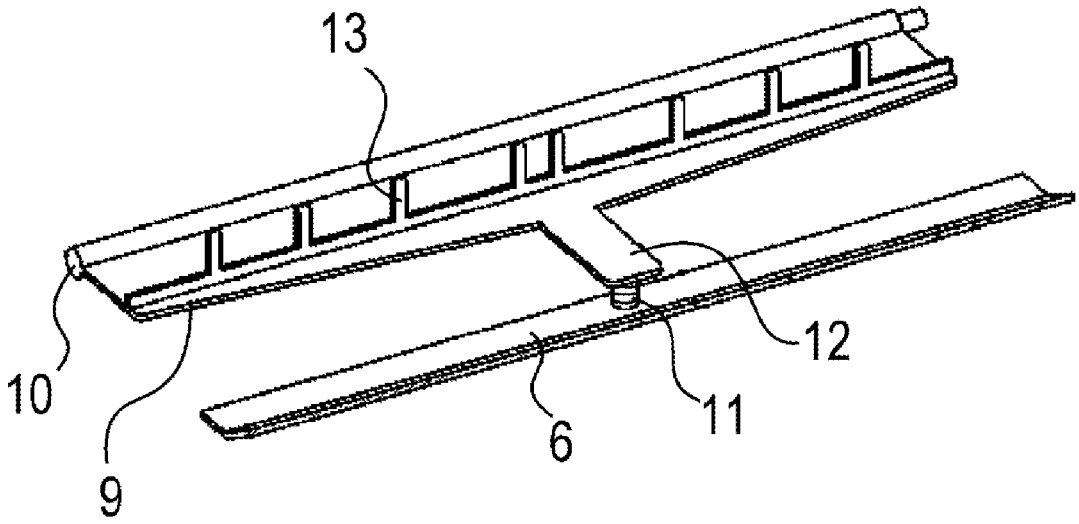
FIG. 3 is a diagram for explaining the configuration of the sheet skew feeding correcting apparatus of the embodiment of the invention.
Figure 4:
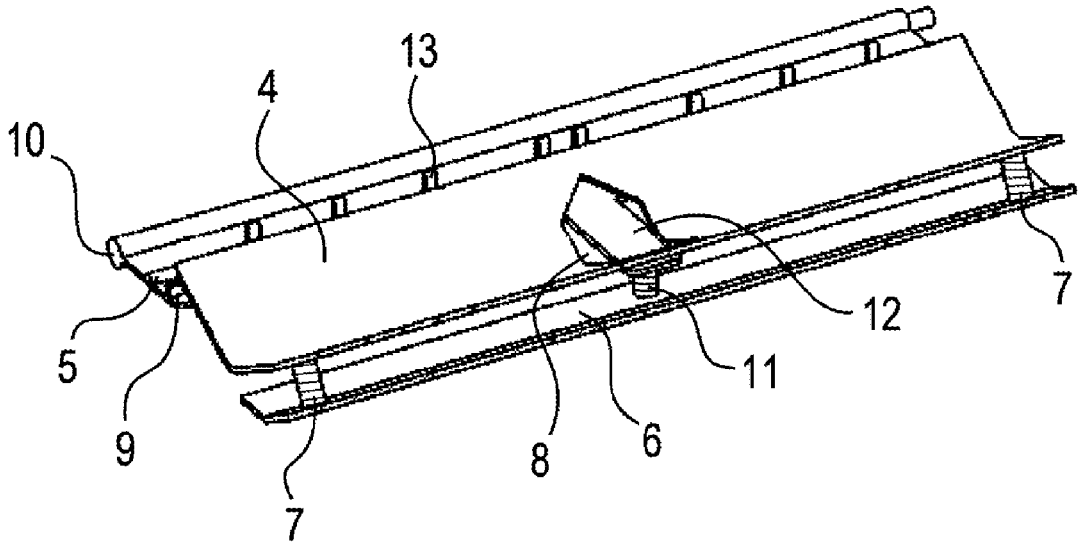
FIG. 4 is a diagram for explaining the configuration of the sheet skew feeding correcting apparatus of the embodiment of the invention.
Figure 5:
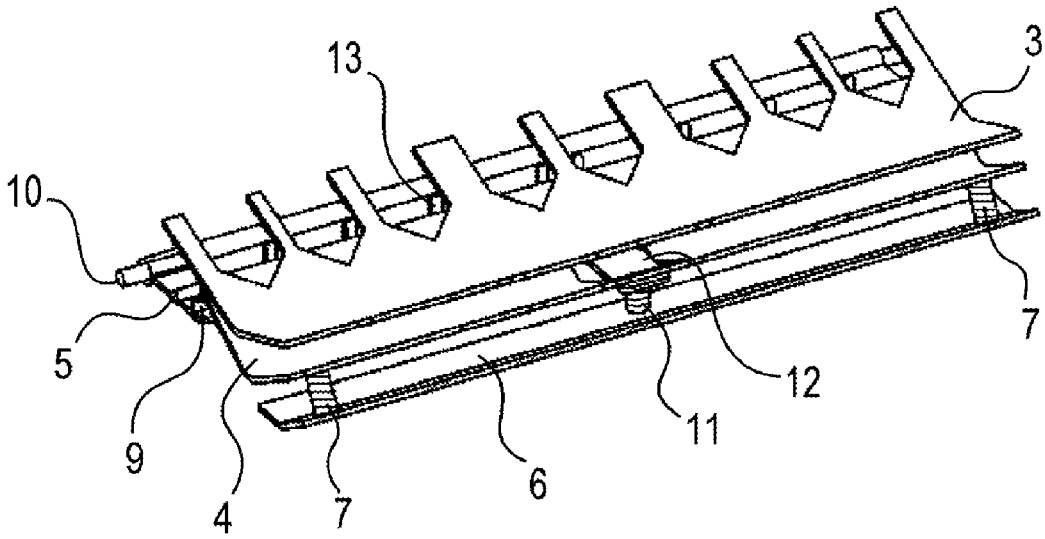
FIG. 5 is a diagram for explaining the configuration of the sheet skew feeding correcting apparatus of the embodiment of the invention.

FIG. 1 is a schematic sectional view of the sheet skew feeding correcting apparatus according to the embodiment, FIG. 2 is a perspective view thereof, and FIGS. 3 to 5 are explanatory diagrams of the configuration thereof.

The sheet skew feeding correcting apparatus B of the embodiment includes a pair of first rollers 1 which are a first sheet conveying apparatus that conveys a sheet fed by the conveying rollers 117, and a pair of second rollers 2 which are a second sheet conveying apparatus disposed downstream from the pair of first rollers 1 in a sheet conveying direction. Each of the pair of first rollers 1 and the pair of second rollers 2 is a pair of sheet conveying rotating members, and when the pair of rollers which nip a sheet at nip portions rotate, a conveying force is applied to the sheet.

As illustrated in FIG. 2, a fixing guide 3 which guides a sheet and a rocking guide 4 are disposed between the pair of first rollers 1 and the pair of second rollers 2. The rocking guide 4 is supported on an apparatus body such that the rocking guide 4 can turn about a turning shaft 5, and the biasing spring 7 applies a force to a fixed plate 6 fixed to the apparatus body in a counterclockwise direction as viewed in FIG. 1. In a state where no force from the sheet is applied to the rocking guide 4, the rocking guide 4 is held at a position illustrated in FIG. 1 by a striking portion (not illustrated).

As illustrated in FIG. 3, a shutter member 9 is supported such that it can turn about a rotating shaft 10, and a biasing spring 11 applies a force to the fixed plate 6 fixed to the apparatus body in the counterclockwise direction as viewed in FIG. 1. In a state where no force from the sheet is applied to the shutter member 9, the shutter member 9 is held at a position illustrated in FIG. 1 by a striking portion 41 (regulating member). The striking portion 41 regulates a moving of the shutter member 9 in a direction (the counterclockwise direction in FIG. 1) in which an abutting force from the leading end of the sheet conveyed is applied.

The shutter member 9 is provided with a sheet locking portion (abutting portion) 13 formed into a comb-teeth shape in a widthwise direction of a sheet. The sheet locking portion 13 is disposed near the pair of second rollers 2 upstream of the nip portion of the pair of second rollers 2 in the sheet conveying direction (hereinafter, "upstream side"). The leading end of a sheet conveyed by the pair of first rollers 1 abuts against the sheet locking portion 13, and the sheet locking portion 13 locks the leading end of the sheet, thereby correcting skew feeding of the sheet. The sheet locking portion 13 is provided at such a position that when the force of the sheet is not applied to the shutter member 9, the leading end of the sheet locking portion 13 enters the fixing guide 3 as illustrated in FIGS. 1 and 5. In this state, a leading end of a sheet conveyed by the pair of first rollers 1 securely abuts against the sheet locking portion 13.

The shutter member 9 is configured such that if the shutter member 9 turns about the rotating shaft 10, the sheet locking portion can move to a first attitude position where the leading end of a sheet conveyed by the first sheet conveying apparatus is locked, and to a second attitude where the leading end of the sheet is not locked. The second attitude of the shutter member 9 is an attitude where the shutter member 9 permits the sheet to pass therethrough.

A loop abutting portion 12 is formed on a portion of the shutter member 9, and a loop portion in a sheet is formed while the sheet is conveyed from the pair of first rollers 1 to the pair of second rollers 2, and the loop portion abuts against the loop abutting portion 12. A notched hole 8 (see FIG. 4) is formed near a central portion of the rocking guide 4 in the widthwise direction (a direction perpendicular to the sheet conveying direction). In a state where the force of a sheet is not applied to the shutter member 9, the loop abutting portion 12 is held such that the loop abutting portion 12 enters a sheet conveying surface of the rocking guide 4 from the notched hole 8 of the rocking guide 4 as illustrated in FIG. 4.

<Function of Shutter Member>

When the leading end of a sheet conveyed by the pair of first rollers 1 is locked by the sheet locking portion 13, an abutment force from the sheet is applied in a direction where the shutter member 9 is held at the first attitude. When a predetermined amount of the loop of a sheet which abuts against the loop abutting portion 12 is generated, an operating amount corresponding to the loop amount is transmitted to the shutter member 9, and the shutter member 9 is moved to the second attitude. That is, the shutter member 9 is moved from the first attitude to the second attitude by a pushing force, against the loop abutting portion 12, by the loop portion of a sheet whose leading end is locked by the shutter member 9. Its configuration will be described with reference to FIGS. 6, 7, and 8A to 8F.

FIGS. 6, 7, and 8A to 8F are diagrams for explaining a motion force exerted on the shutter member 9 by a conveying force F by the pair of first rollers 1 when a leading end of a sheet S abuts against the sheet locking portion 13 of the shutter member 9 and is locked.

Figure 6:
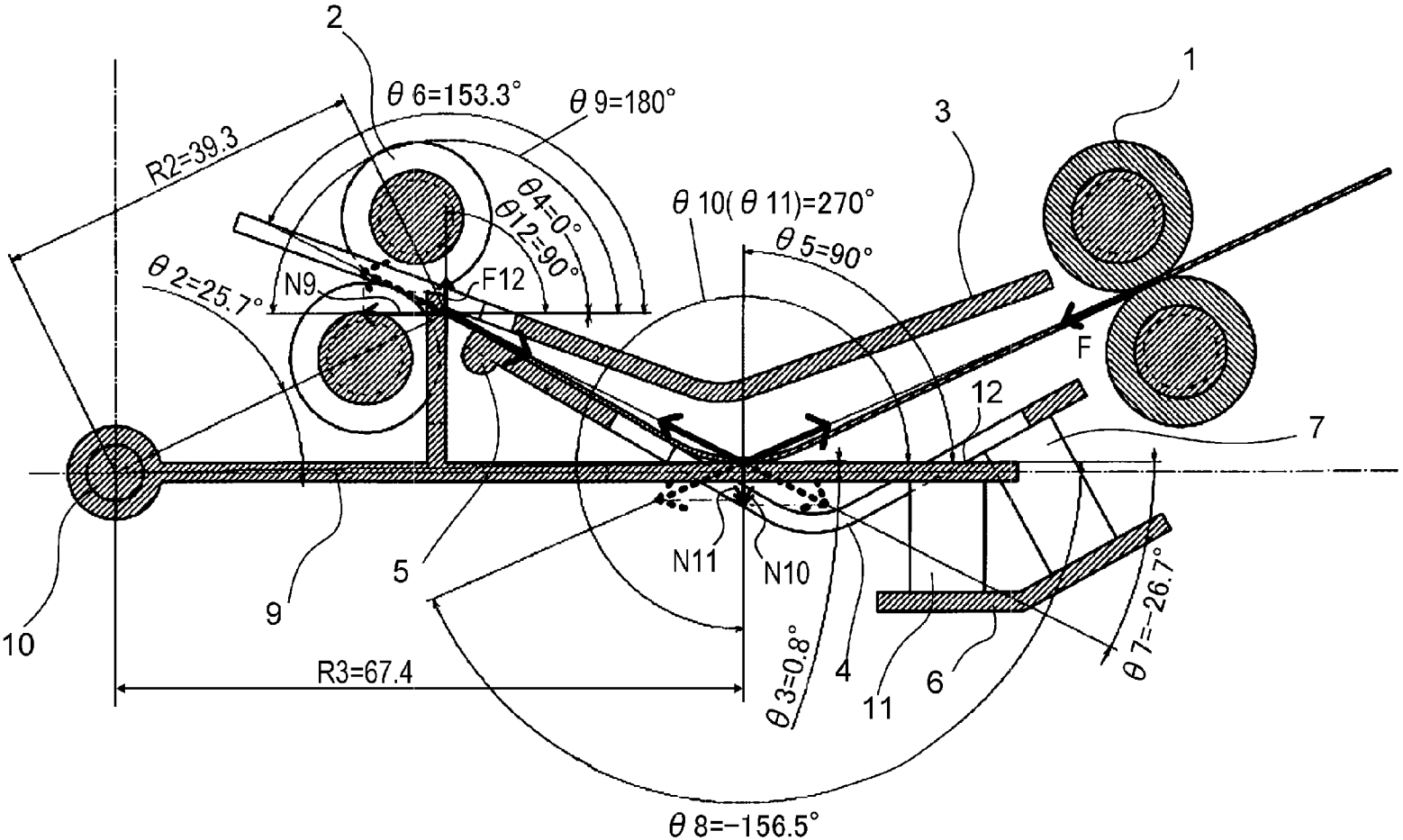
FIG. 6 is a diagram for explaining a motion force applied to a shutter of the embodiment of the invention.

As illustrated in FIG. 6, a polar coordinate system in which the rotating shaft 10 of the shutter member 9 is defined as an origin and a counterclockwise direction is defined as a normal direction of an angle. Polar coordinates of the sheet locking portion 13 are defined as R2 and θ2, polar coordinates of the loop abutting portion 12 are defined as R3 and θ3, a normal vector direction of a locking surface (abutting surface) of the sheet locking portion 13 is defined as θ4, a normal vector direction of a loop abutting surface of the loop abutting portion 12 is defined as θ5, an applying direction of a sheet conveying force F to the locking surface of the sheet locking portion 13 is defined as θ6, a loop abutting force direction applied from a downstream side to the loop abutting surface of the loop abutting portion 12 is defined as θ7, a loop abutting force direction applied from an upstream side to the loop abutting surface of the loop abutting portion 12 is defined as θ8, and a friction coefficient between the sheet locking portion 13 and a leading end of a sheet is defined as μ.

Here, if a vertical drag of an abutting force from a leading end of a sheet against the locking portion 13 is defined as N9, and a direction of the force is defined as θ9, the following equations (1) and (2) are established:

$$N9=F\times\mathrm{Cos}(\theta4+\pi-\theta6) \quad (1)$$

$$\theta9=\theta4+\pi \quad (2).$$

A vertical drag N10 and a direction θ10 of an abutting force from downstream toward the loop abutting portion 12 can be obtained by the following equations (3) and (4):

$$N10=F\times\mathrm{Cos}(\theta5+\pi-\theta7) \quad (3)$$

$$\theta10=\theta5+\pi \quad (4).$$

A vertical drag N11 and a direction θ11 of an abutting force from upstream toward the loop abutting portion 12 can be obtained by the following equations (5) and (6):

$$N11=F\times\mathrm{Cos}(\theta5+\pi-\theta8) \quad (5)$$

$$\theta11=\theta5+\pi \quad (6).$$

A friction force F12 and a direction θ12 between a leading end of a sheet and the locking portion 13 can be obtained by the following equations (7) and (8):

$$F12=\mu\times N9 \quad (7)$$

$$\theta12=\theta4+\pi/2 \text{ (or } \theta4-\pi/2) \quad (8).$$

Figure 7:
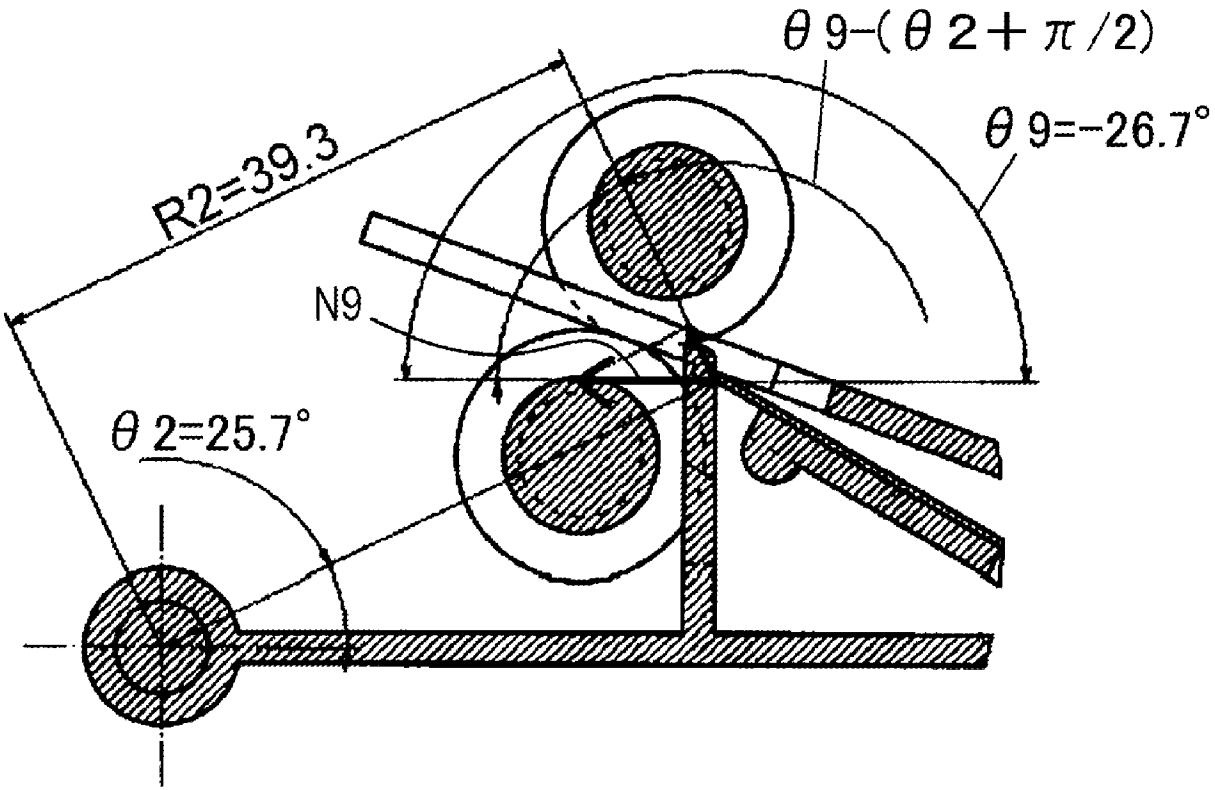
FIG. 7 is a diagram for explaining moment caused by a vertical drag.

Moment around the rotating shaft 10 of the shutter by these forces is as follows:

As illustrated in FIG. 7, moment M13 caused by the vertical drag N9 is obtained by extracting a rotating direction component as viewed from a turning center of the vertical drag N9 and by multiplying the rotating direction component by a turning radius R2 as follows:

$$M13=N9\times R2\times\mathrm{Cos}(\theta9-(\theta2+\pi/2)) \quad (9)$$

Similarly, since moment caused by a friction force F12 is a drag when the friction force opens the shutter, the moment acts as moment in a shutter closing direction. If the angle in the shutter closing direction is positive in the polar coordinate system, $$M14=|F12\times R2\times\mathrm{Cos}(\theta12-(\theta2+\pi/2))| \quad (10)$$

Moment M15 caused by a vertical drag N10 is:

$$M15=N10\times R3\times\mathrm{Cos}(\theta10-(\theta3+\pi/2)) \quad (11).$$

Moment M16 caused by a vertical drag N11 is:

$$M16=N11\times R3\times\mathrm{Cos}(\theta11-(\theta3+\pi/2)) \quad (12).$$

If moment caused by a preliminary force applied to the shutter member 9 by the biasing spring 11 is defined as M0, in order to continuously operate the shutter without an actuator, it is necessary to close the shutter member 9 when the force of the sheet is not applied to the shutter member 9. That is, the following condition is required:

$$M0>0 \quad (13).$$

Next, a sheet strikes the sheet locking portion 13, and while a loop grows up by conveyance of the pair of first rollers 1, moment caused by a conveying force F applied to the shutter member 9 is $$M0+M13 \quad (14).$$

At that time, a condition for reliably locking a sheet without opening the shutter member 9 is as follows:

$$M0+M13>0 \quad (15).$$

In this process, a conveying force from the pair of first rollers 1 transmitted to a leading end of a sheet is influenced by firmness and posture of the sheet, and a magnitude of the conveying force is unstable. Therefore, in order to reliably satisfy the equation (15) under the condition of the equation (13), $$\text{if } M13>0 \quad (16)$$

is established, it is possible to maintain a state where the shutter member 9 is left closed without being influenced by slight variation of an absolute value.

Next, if the loop further grows up and the loop abuts against the loop abutting portion 12, resultant moment of the following equation (17) is applied to the shutter member 9:

$$M0+M13+M14+M15+M16 \quad (17).$$

In order to open the shutter member 9, it is necessary to establish the following equation (18):

$$M0+M13+M14+M15+M16<0 \text{(application in a direction in which the shutter opens)} \quad (18).$$

To establish this equation under the condition of the equation (13), it is necessary to establish the following equation (19):

$$M13+M14+M15+M16<0 \quad (19),$$

and if this equation is established, M0 should be set to a sufficiently small value and the equation (13) should be satisfied.

That is, when the equations (16) and (19) are satisfied, the shutter member can continuously and reliably correct skew feeding only by applying a small preliminary force.

When the equations (1) to (12) are substituted into the equations (16) and (19), and the result thereof is divided by a common denominator and is then rearranged, the following equations (20) and (21) are yielded:

$$\mathrm{Cos}(\theta4-\theta6+\pi)\times\mathrm{Cos}(\theta4-\theta2+\pi/2)>0 \quad (20)$$

and $$\begin{aligned} &R2\times\mathrm{Cos}(\theta4-\theta6+\pi)\times\mathrm{Cos}(\theta4-\theta2+\pi/2)+ \\ &|\mu\times R2\times\mathrm{Cos}(\theta4-\theta6+\pi)\times\mathrm{Cos}(\theta4-\theta2)|+ \\ &R3\times\mathrm{Cos}(\theta5+\pi-\theta7)\times\mathrm{Cos}(\theta5-\theta3+\pi/2)+ \\ &R3\times\mathrm{Cos}(\theta5+\pi-\theta8)\times\mathrm{Cos}(\theta5-\theta3+\pi/2)<0. \end{aligned} \quad (21)$$

That is, if a cross sectional shape and π of the locking portion 13 satisfy the above conditions, it is possible to carry out the continuous and reliable shutter operation.

The condition of the cross section shape, μ, and calculation results of the moment in this embodiment are illustrated in FIGS. 8A to 8F.

In this embodiment, R2=39.3 (mm), R3=67.4 (mm), the turning center of the shutter member 9, the position of the sheet locking portion 13 and the position of the loop abutting portion 12 are disposed at positions illustrated by No. 1 to No. 3 in FIG. 8A. The shape of the shutter member 9 is configured such that the thermal vector direction θ4 of the normal vector of the locking surface of the sheet locking portion 13, and the normal vector direction θ5 of the loop abutting surface of the loop abutting portion are No. 4 and No. 5 in FIG. 8B.

The shape of the sheet locking portion 13 of the shutter member 9 is formed, and the rocking guide 4 and the fixing guide 3 are disposed, so that a vector (applying direction θ6 of the sheet conveying force to the locking surface of the sheet locking portion) of the force applied to the sheet locking portion 13 of the shutter member 9 becomes No. 6 in FIG. 8C.

The shape of the shutter member 9 is formed, and the rocking guide 4 and the fixing guide 3 are disposed, so that a vector (direction θ7 of the loop abutting force applied to the loop abutting surface of the loop abutting portion from the downstream side of the sheet conveying direction) of the force of the loop of the sheet applied from the downstream side to the loop abutting portion 12 becomes No. 7 in FIG. 8C.

The shape of the shutter member 9 and the direction of a nip line of the pair of first rollers 1 are set such that a vector (loop abutting force direction θ8 from the upstream side in the sheet conveying direction to a loop abutting surface of the loop abutting portion) of the force of the loop of the sheet applied to the loop abutting portion 12 of the shutter member 9 from the upstream becomes No. 8 in FIG. 8C.

In the above-described configuration, if the vertical drag N9 of an abutting force from the leading end of a sheet to the locking portion 13, the vertical drag N10 of an abutting force from downstream to the loop abutting portion 12, the vertical drag N11 of an abutting force from upstream to the loop abutting portion 12, and a friction force F12 between the leading end of the sheet and the locking portion 13 are calculated based on the above-described equations, they become No. 9 to No. 12 in FIGS. 8D and 8E.

If the moment values M13 to M16 of the forces applied to the shutter member 9 are calculated based on the above-described equations, the moment values become No. 3 to No. 16 in FIG. 8F.

In this embodiment, the equation (20) is satisfied as follows. That is, $$\begin{aligned}\mathrm{Cos}(\theta 4-\theta 6+\pi)\times\mathrm{Cos}(\theta 4-\theta 2+\pi/2) &= \mathrm{Cos}(0-153.3+180)\times \\ &\quad \mathrm{Cos}(0-25.7+90) \\ &= 0.39>0\end{aligned}$$

In this embodiment, the equation (21) is satisfied as follows. That is, $$\begin{aligned}&R2\times\mathrm{Cos}(\theta 4-\theta 6+\pi)\times\mathrm{Cos}(\theta 4-\theta 2+\pi/2)+ \\ &\quad |\mu\times R2\times\mathrm{Cos}(\theta 4-\theta 6+\pi)\times\mathrm{Cos}(\theta 4-\theta 2)|+ \\ &\quad R3\times\mathrm{Cos}(\theta 5+\pi-\theta 7)\times\mathrm{Cos}(\theta 5-\theta 3+\pi/2)+ \\ &\quad R3\times\mathrm{Cos}(\theta 5+\pi-\theta 8)\times\mathrm{Cos}(\theta 5-\theta 3+\pi/2)=\end{aligned}$$

-continued $$\begin{aligned}&39.3\times\mathrm{Cos}(0-153.3+180)\times\mathrm{Cos}(0-25.7+90)+| \\ &\quad 0.40\times 39.3\times\mathrm{Cos}(0-153.3+180)\times\mathrm{Cos}(0-25.7)| \\ &\quad +67.4\times\mathrm{Cos}(90+180-(-26.7))\times\mathrm{Cos}(90-0.8+90)+ \\ &\quad 67.4\times\mathrm{Cos}(90+180-(-156.5))\times\mathrm{Cos}(90-0.8+90)=-9.4<0\end{aligned}$$

$$M13+M14=27.9\times F \tag{22}$$

$$M13+M14+M15+M16=-29.3\times F \tag{23},$$

and smooth shutter operation could be realized by setting a preliminary force applied by the biasing spring 11 to a value small enough to overcome the weight of the shutter member 9 in the counterclockwise direction in FIG. 1.

The shutter operation when a sheet is conveyed will be described in time sequence with reference to FIGS. 9A to 9G and FIG. 10. FIGS. 9A to 9G illustrate states of the shutter operation when a sheet is conveyed, and FIG. 10 illustrates, in time sequence, moment applied to the shutter member 9 at that time.

Figure 9A:
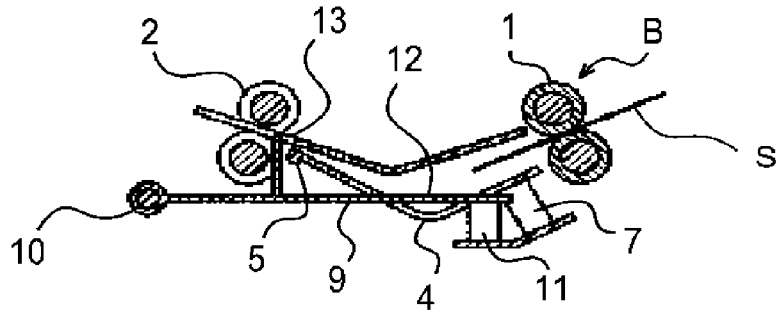
FIGS. 9A to 9G are diagrams for explaining, in time sequence, a motion force applied to the shutter of the embodiment of the invention.
Figure 10:
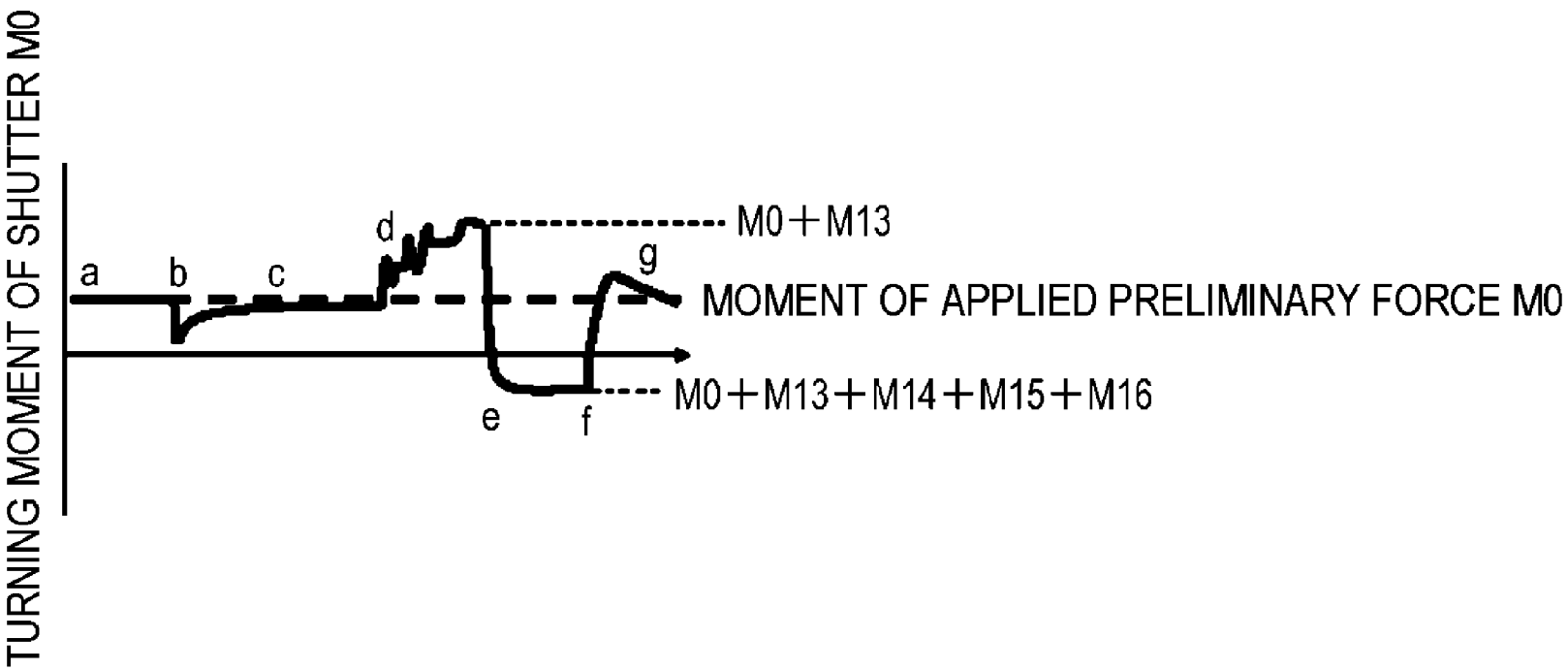
FIG. 10 is a diagram for explaining, in time sequence, a motion force applied to the shutter of the embodiment of the invention.

In FIG. 9A, only a preliminary force is applied to the shutter member 9, and the shutter member 9 is maintained in its closed state.

Figure 9B:
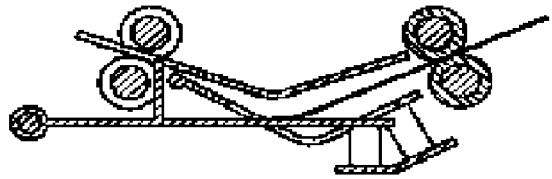
Figure 9C:
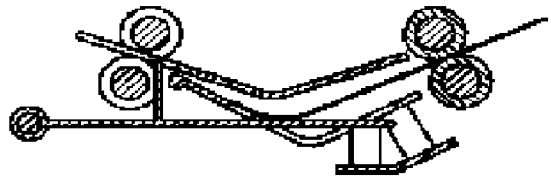

In FIG. 9B, as soon as the leading end of a sheet conveyed by the pair of first rollers 1 plunges into the loop abutting portion 12, slight moment is applied in a shutter opening direction, but it is buckled and the moment in the opening direction is soon reduced as illustrated in FIG. 9C.

Figure 9D:
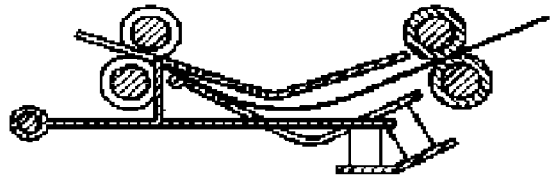

In FIG. 9D, if the leading end of the sheet abuts against the sheet locking portion 13, a moment in the closing direction is further applied to the shutter member 9, and the leading end of the sheet is reliably locked.

Figure 9E:
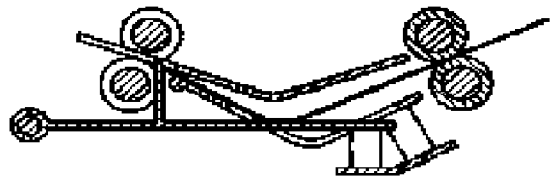

In FIG. 9E, if the loop formed in the sheet conveyed by the pair of first rollers 1 abuts against the loop abutting portion 12, the loop portion of the sheet pushes the loop abutting portion 12, a moment in the opening direction is applied is applied to the shutter member 9, and the shutter is opened.

As illustrated in FIG. 4, the loop abutting portion 12 is provided only near the central portion in the direction perpendicular to the sheet conveying direction. Therefore, even if a skew feeding amount of a sheet is large and there is a difference in size of the loop between a front portion and a rear portion of the loop, the rocking guide 4 escapes and the loop space is widened. Therefore, only an average loop at the central portion of the sheet in the width direction abuts against the loop abutting portion 12. Accordingly, it is possible to carry out a skew feeding correcting operation of wide range which is not influenced by a difference between the front and rear portions of the loop.

That is, when attempt is made to operate the shutter member 9 with a loop of a sheet and the sheet which is largely inclined strikes the shutter member 9, a difference in size of the loop is generated depending upon the position thereof in the width direction. Therefore, there is an adverse possibility that the shutter member 9 opens before skew feeding is sufficiently corrected.

In this embodiment, however, only the central portion of the loop of the sheet in the width direction abuts against the loop abutting portion 12 of the shutter member 9 and therefore, even if the skew feeding amount of the sheet is large and there is a difference in size of the loop between a front portion and a rear portion of the loop, the shutter member 9 is moved after the skew feeding is sufficiently corrected. In other words, both ends of a loop portion of a sheet do not come into contact with the loop abutting portion 12 by the rocking guide 4.

Figure 9F:
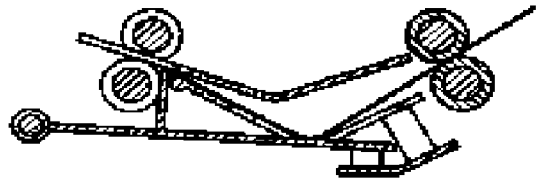
Figure 9G:
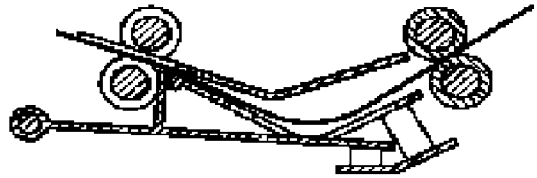

Next, in FIG. 9F, when the shutter opens and the leading end of the sheet passes through the sheet locking portion 13, the sheet is nipped between and conveyed by the pair of second rollers 2 (FIG. 9G).

When the rear end of the sheet passes through the pair of second rollers 2, the shutter member 9 is returned to the state where it is closed by the preliminary force applied thereto, and is prepared for the skew feeding correcting operation for a next sheet.

As described above, according to the sheet skew feeding correcting apparatus of the embodiment, it is possible to realize, over a wide correcting range, a continuous skew feeding correcting operation without using an actuator or the like.

In this embodiment, the loop abutting portion 12 of the shutter member 9 is integral with the shutter member 9. However, a loop abutting portion 12 which is formed by a separate member may be coupled to the shutter member 9 to be moved together. Further, it is possible to employ such a configuration that the loop abutting portion 12 is formed independently from the shutter member 9, and when a loop formed by a conveyed sheet pushes the loop abutting portion 12, the loop abutting portion 12 which is operated by its abutting force operates the shutter member 9 to move the same to the second attitude.

According to the sheet skew feeding correcting apparatus of the embodiment, when the leading end of a conveyed sheet abuts against the sheet locking portion, its abutting force acts in a shutter closing direction. Therefore, even if the abutting force of the leading end of the sheet is varied, the leading end of the conveyed sheet is reliably locked by the sheet locking portion, and skew feeding of the sheet is reliably corrected. Further, the sheet whose leading end is locked by the sheet locking portion forms a stable loop, and this abuts against the loop abutting portion. The stable loop abutting force at that time can reliably open the shutter.

Only the stable loop amount near the central portion in the direction perpendicular to the sheet conveying direction gives an operating amount to the shutter member 9, and the correcting range of skew feeding can be enhanced with the simple configuration.

Since there is no needless friction part, the sheet conveying force can be efficiently converted into the opening/closing motion of the shutter, and it is possible to realize a reliable shutter having no buckle of a loop with a simple configuration.

Further, it is possible to obtain an appropriate range between a shutter-closing force by an abutting force of the leading end of a sheet and a shutter-opening force by abutment of a loop. If the preliminary force which is previously applied to the shutter is set within this range, even when a plurality of sheets are continuously conveyed, it is possible to realize a reliable shutter motion without a returning failure of the shutter only by a geometric relation between a turning center of the shutter, the direction of the sheet abutment portion of each guide surface and a position.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-060152, filed Mar. 17, 2010, which is hereby incorporated by reference herein in its entirety.

What is claimed is:

1. A sheet skew feeding correcting apparatus comprising:

a sheet conveying unit which conveys a sheet;

a pair of sheet conveying rotating members which is disposed downstream of the sheet conveying unit in a sheet conveying direction;

a shutter member which rotates between a first position where the shutter member abuts against a leading end of the sheet conveyed by the conveying unit and a second position where the shutter member permits the sheet to pass therethrough;

an abutting portion, disposed on the shutter member, which abuts the leading end of the conveyed sheet upstream of a nip portion of the pair of sheet conveying rotating members when the shutter member is at the first position, wherein a loop is formed on the conveyed sheet whose leading end abuts the shutter member;

a loop abutting portion, disposed on the shutter member, against which a loop portion of the conveyed sheet abuts; and a regulating portion that regulates a rotation of the shutter member in a first direction in which the shutter member rotates by an abutting force from the leading end of the sheet conveyed by the sheet conveying unit, wherein the shutter member is rotated in a second direction opposed to the first direction by the pressing force of the loop portion of the conveyed sheet to the loop abutting portion, and thereby the shutter member rotate from the first position to the second position.

2. The sheet skew feeding correcting apparatus according to claim 1, wherein to move the shutter member, the loop abutting portion transmits an operating amount corresponding to a loop amount formed in the sheet near a central portion in a width direction perpendicular to the conveying direction.

3. The sheet skew feeding correcting apparatus according to claim 2, further comprising a movable guide that guides the sheet at both sides of the loop abutting portion in the width direction.

4. The sheet skew feeding correcting apparatus according to claim 1, wherein the shutter member turns about a turning center to move between the first attitude and the second attitude.

5. An image forming apparatus comprising:

a sheet conveying unit which conveys a sheet;

a pair of sheet conveying rotating members which is disposed downstream of the sheet conveying unit in a sheet conveying direction;

an image forming section which forms an image on a sheet conveyed;

a shutter member which rotates between a first position where the shutter member abuts against a leading end of the sheet conveyed by the conveying unit and a second position where the shutter member permits the sheet to pass therethrough;

an abutting portion, disposed on the shutter member, which abuts the leading end of the conveyed sheet upstream of a nip portion of the pair of sheet conveying rotating members when the shutter member is at the first position, wherein a loop is formed on the conveyed sheet whose leading end abuts the shutter member;

a loop abutting portion, disposed on the shutter member, against which a loop portion of the conveyed sheet abuts;

a regulating portion that regulates a rotation of the shutter member in a first direction in which the shutter member rotates by an abutting force from the leading end of the sheet conveyed by the sheet conveying unit, wherein the shutter member is rotated in a second direction opposed to the first direction by the pressing force of the loop portion of the conveyed sheet to the loop abutting portion, and thereby the shutter member rotates from the first position to the second position.

6. An image forming apparatus according to claim 5, wherein to move the shutter member, the loop abutting portion transmits an operating amount corresponding to a loop amount formed in the sheet near a central portion in a width direction perpendicular to the conveying direction.

7. An image forming apparatus according to claim 6, further comprising a movable guide that guides the sheet at both ends of the loop abutting portion in the width direction.

8. An image forming apparatus according to claim 5, wherein the shutter member turns about a turning center to move between the first attitude and the second attitude.

9. A sheet skew feeding correcting apparatus comprising:

a sheet conveying unit which conveys a sheet;

a pair of sheet conveying rotating members which is disposed downstream of the sheet conveying unit in a sheet conveying direction;

a conveying guide, configured to guide the conveyed sheet and provided between the sheet conveying unit and the pair of sheet conveying rotating members, wherein a conveying guide forms a conveying path through which the conveyed sheet is conveyed;

an opening formed on the conveying guide;

a shutter member having, an abutting portion to which leading end of the sheet abuts and a loop abutting portion to which a loop portion of the conveyed sheet whose leading end is abutted to the shutter member abuts; and a holder configured to hold the shutter member in a state that the loop abutting portion enters into the conveying path through the opening and to hold the shutter member so that the shutter member moves from a first position where the shutter member abuts the leading end of the conveyed sheet to a second position where the shutter member permits the sheet to pass through by a pressing force of the loop portion of the sheet to the loop abutting portion.

10. The sheet skew feeding correcting apparatus according to claim 9, wherein the opening formed on the conveying guide is provided at a central portion of the width direction perpendicular to a sheet conveyance direction.

* * * * *